United States Patent [19]

Goupil et al.

[11] 4,353,549

[45] Oct. 12, 1982

[54] HOCKEY STICK

[76] Inventors: Marcel Goupil, 88 Gall Blvd., Drummondville, Canada, J2C 1H6; Léo Tessier, 1 Guevremont St., Drummondville, Canada, J2B 2H2

[21] Appl. No.: 225,243

[22] Filed: Dec. 29, 1980

[30] Foreign Application Priority Data

Dec. 11, 1980 [CA] Canada ..... 366588

[51] Int. Cl.[3] ..... A63B 59/14

[52] U.S. Cl. ..... 273/67 A

[58] Field of Search ..... 273/67 R, 67 A, 67 D, 273/67 DA, 72 R, 73 R, 73 F, 73 G, 73 J, 80 R, 80.2, 80.9; 145/2 R; 280/610, 819

[56] References Cited

U.S. PATENT DOCUMENTS 3,677,542 7/1972 Michaud ..... 273/67 A

FOREIGN PATENT DOCUMENTS 36022 2/1967 Finland ..... 273/67 A
242479 11/1925 United Kingdom ..... 273/73 F
336027 10/1930 United Kingdom ..... 273/67 A
637779 5/1950 United Kingdom ..... 273/67 A
1093528 12/1967 United Kingdom ..... 273/67 A

*Primary Examiner*—Anton O. Oechsle

[57] ABSTRACT

There is disclosed a hockey stick made of wood and the handle of which has a solid core of light density wood and laterally opposite outer laminations of high density wood, the handle being characterized by having a tapering lower and portion produced by tapering of the lighter and weaker core rather than through external tapering of the heavier and stronger outer layers. The hockey stick also includes a blade with a core portion to merge in thickness with the handle at the spliced joint between the handle and the blade.

12 Claims, 4 Drawing Figures

HOCKEY STICK

FIELD OF INVENTION

The present invention relates to a hockey stick made of wood and, more particularly, to the construction of the hockey stick handle.

BACKGROUND OF THE INVENTION

It is known to provide a hockey stick handle made of a core of low density and weaker wood and opposite outer laminations of high density and stronger wood adhered against the opposite sides of the core.

It has been a practice so far to merge the thickness of the handle with the thickness of the blade at the spliced joint between the two by removing the wood from the opposite lateral sides of the assembly. The lateral tapering of the handle towards the blade was thus achieved by reducing the thickness of the outer laminations. The corresponding end of the handle was thus made unnecessarily too weak.

It is also known to provide a handle for a hockey stick made of a core reinforced on opposite sides with longitudinally-extending fibers, such as fiberglass fibers, which are adhered to the wooden core by an epoxy glue. However, such an epoxy glue is about ten times as expensive as conventional wood glue, and its use is furthermore prohibited in certain countries, because it is a health hazard to workers.

OBJECTS OF THE INVENTION

It is a general object of the present invention to provide a hockey stick made entirely of wood to avoid the use of epoxy glue and which, at the same time, conserves a maximum strength in the tapering portion of the handle.

It is another object of the invention to provide a hockey stick handle entirely made of wood, where in advantage is taken of the higher strength of the high density wood laminations, compared to the low density wood core in the tapering portion of the handle, which finally merges with the blade of hockey stick.

SUMMARY OF THE INVENTION

There is provided, in accordance with the present invention, an elongated handle for a hockey stick, said handle being straight and having a substantially uniform cross-section over the major portion thereof and a progressively-tapering terminal portion, said handle being made of a solid core of low density wood and of lateral laminations of high density wood, only the core tapering in said terminal portion, while said lateral laminations remain substantially of the same thickness throughout the length of said handle.

The hockey stick of the invention includes a handle above described in combination with a blade extending laterally from the terminal portion of the handle and connected thereto by a spliced joint.

The above will be better understood with reference to the following detailed description of a preferred embodiment which is illustrated by way of example in the accompanying drawings.

DETAILED DESCRIPTION

Figure 1:
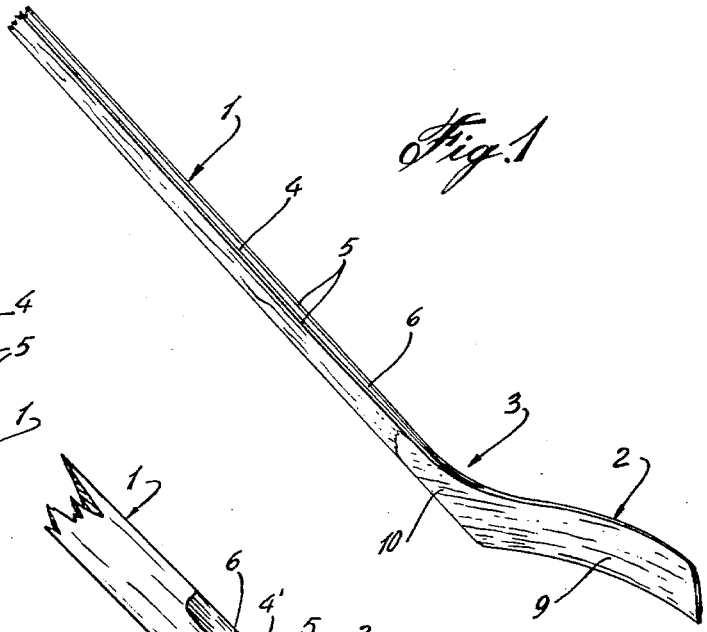
FIG. 1 is a perspective view of a hockey stick according to a preferred embodiment of the present invention.
Figure 2:
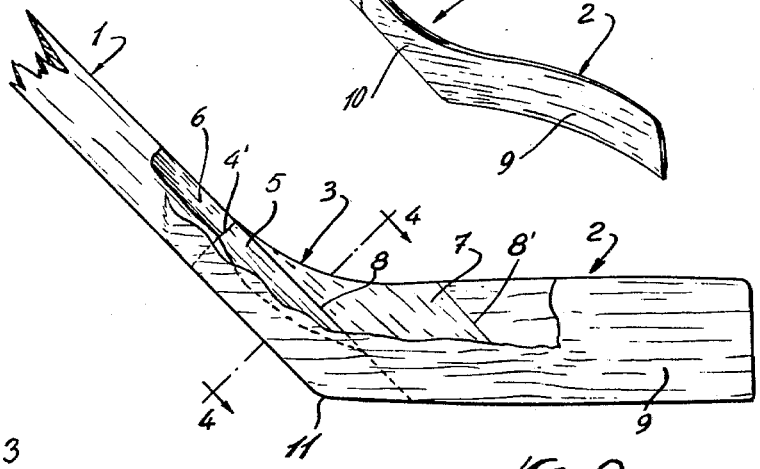
FIG. 2 is an enlarged side view of the blade and lower portion of the hockey stick handle of FIG. 1.
Figure 3:
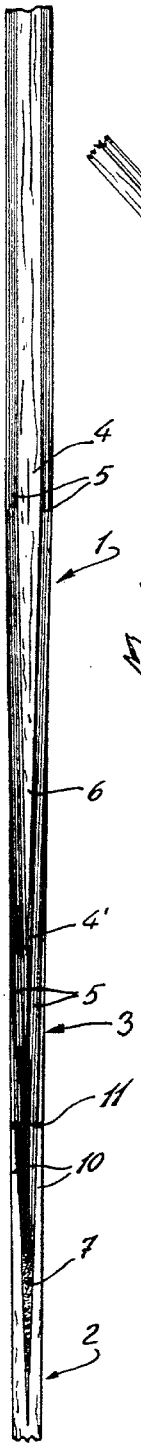
FIG. 3 is an elevational view looking at the back of the handle and showing part of the bottom edge of the blade.
Figure 4:
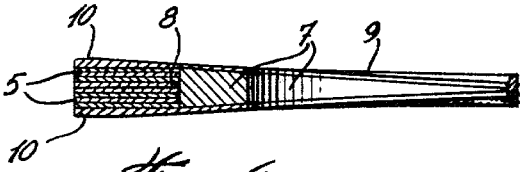
FIG. 4 is a cross-sectional view through the spliced joint of the same hockey stick as seen along line 4—4 in FIG. 2.

The illustrated hockey stick comprises a handle 1, a blade 2 and a spliced joint 3 connecting the handle and the blade together. Each of these parts of the hockey stick is made of wood, as will be explained hereinafter in detail. The handle 1 is straight, has a rectangular cross-section with its wider faces generally parallel to the main faces of the blade 2. Handle 1 has a major portion of substantially uniform cross-section and a progressively-tapering terminal portion to finally merge with the thickness of the blade at the spliced joint. Handle 1 includes a core 4, of low density wood, that is wood weighing less than 0.5 grams per cemtimeter cube, such as fir-tree, white spruce, black spruce, pine, poplar, linden-tree, aspen or apache (an African tree). Core 4 is made of solid wood and is sandwiched at its wider faces between outer laminations 5. The laminations 5, together with the core 4, are glued together by means of ordinary glue for wood. The outer laminations 5 are made of a high density wood, that is a wood weighing more than 0.5 gram per centimeter cube and preferably made of white or yellow birch. The handle 1 has a lower end portion that laterally tapers to merge in thickness with blade 2. This is distinctively and more advantageously achieved by tapering the lower end portion of the core 4, as shown at 6, and terminating said core at 4', while the outer laminations 5 remain of substantially the same thickness throughout the length of the handle. These outer laminations 5 extend much beyond the terminal edge 4' of the core 4. The sum of the thicknesses of the two groups of outer laminations 5 is at between 20% and 80%, and preferably 56%, of the total thickness of the handle in its major portion of uniform cross-section. A very strong handle terminal portion at the spliced joint 3 and also throughout the tapering portion 6 of the core is obtained, since the thickness of the two groups of outer laminations is practically not decreased and since the wood of these laminations is of higher strength than the wood of core 4. Yet the terminal portion of the handle is thin enough to achieve a spliced joint with blade 2. The blade 2 is formed of two wood laminations 9, which directly adhere one to another at the outer end portion of the blade and which then diverge, being separated by a solid core 7 that tapers towards the outer end of the blade to terminate along the inclined edge 8', which is substantially parallel to the long axis of the handle 1. The thicker part of core 7 is secured to the front face of the laminations 5, as indicated at 8, while the outer laminations 9 of the blade continue and overlap the terminal laminations 5 of the handle, as shown at 10. The outer laminations 5 terminate at the heel 11 of the hockey stick and along the bottom edge of the blade. The portions 10 of the blade laminations 9 taper upwardly on handle 1 to further finally merge with the external main faces of said handle.

It will be noted that the handle 1 has the same transverse dimension between its front and back faces, that is the narrower faces, throughout the length of the handle.

It follows that the handle can be made by sawing straight strips of the desired width from a premanufactured panel including the core 4 and the outer laminations 5, together with the tapered portion 6 of the core and the contiguous laminations 5 at the terminal portion of the panel. The resulting handles are part of the present invention.

What we claim is:

1. A handle for a hockey stick, said handle being elongated and straight and having a rectangular cross-section defining a pair of opposite wider lateral faces and a pair of opposite narrower faces, said handle having a substantially uniform cross-section over the major portion thereof and a progressively-tapering terminal portion, the taper of said terminal portion being across said narrower opposite faces, said handle being made of a core of low density wood and of two groups of lateral laminations of high density wood between which said core is sandwiched throughout its length, said core and laminations adhering to one another, said lateral laminations defining said wider opposite faces, the core section which extends in said terminal portion tapering across said narrower opposite faces, and the thickness of each group of laminations across said narrower faces being substantially uniform throughout the length of said handle.

2. A handle for a hockey stick as defined in claim 1, wherein said core terminates short of the lower end of said handle, while said lateral laminations extend beyond said core and the two groups of laminations adhere directly one to another in the the part of said terminal portion which extends beyond said core.

3. A handle for a hockey stick as defined in claim 2, wherein the outer end of said terminal portion is at a bevel.

4. A handle for a hockey stick as claimed in claim 1, 2 or 3, wherein the sum of the thicknesses of the two groups of laminations is equal to at least 20% of the total thickness of the major portion of said handle.

5. A handle for a hockey stick as defined in claim 1, 2 or 3, wherein said core is made of solid wood and said laminations extend longitudinally of said handle.

6. A handle for a hockey stick as defined in claim 1, 2 or 3, wherein the sum of the thicknesses of the two groups of laminations is between 20% and 80% of the total thickness of the major portion of the handle.

7. A handle for a hockey stick as defined in claim 1, 2 or 3, wherein the sum of the thicknesses of the two groups of outer laminations is 56% of the total thickness of the major portion of the handle.

8. A handle for a hockey stick as claimed in claim 1, 2 or 3, wherein said core of low density wood is a solid mass of wood selected from the group consisting of white spruce, black spruce, fir-tree, pine, poplar, linden-tree, aspen and apache, and said outer laminations of high density wood are selected from the group consisting of white birch and yellow birch.

9. A handle for a hockey stick as defined in claim 1, 2 or 3, wherein said low density wood weighs less than 0.5 gram per centimeter cube.

10. A hockey stick comprising an elongated handle and a blade connected to the lower end of said handle by a spliced joint, the elongated handle being straight and of rectangular cross-section defining wider opposite lateral faces in the general plane of said blade and narrower opposite front and back faces transvers to said blade, said handle having a major portion of substantially uniform cross-section and a terminal portion defining the lower end of said handle and which progressively tapers transversely of said blade, said handle being made of a core of low density wood and of two groups of longitudinally-extending lateral laminations between which said core is sandwiched throughout its length, said core and laminations adhering to one another, said laminations defining said wider faces, the core section which extends in said terminal portion tapering transversely of said blade, the thickness of each group of laminations transversely of said blade being substantially uniform throughout the length of said blade, said blade formed of two laminations overlapping said lower end of said handle to define said spliced joint.

11. A hockey stick as defined in claim 10, wherein said core terminates short of said laminations in said terminal portion of the handle and the portions of the two groups of laminations lying beyond said core adhere directly to each other, the laminations of said blade overlapping and overlying the outer wider faces of said handle in the spliced joint area, and further including a wedge-shape core adhering to the front narrower face of said handle in said terminal portion and sandwiched between the blade laminations.

12. A hockey stick as claimed in claim 10 or 11, wherein said core of said handle has a density of less than 0.5 gram per centimeter cube and the sum of the thicknesses of the two groups of laminations lies between 20% and 80% of the total thickness of the handle in its major portion.

* * * * *